US007497706B2

(12) United States Patent
Daudin et al.

(10) Patent No.: US 7,497,706 B2
(45) Date of Patent: Mar. 3, 2009

(54) DEVICE FOR LOCKING A CONNECTOR MODULE IN A MODULE HOLDER

(75) Inventors: Philippe Daudin, Pierres (FR); Gilles Schmitt, Senantes (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/583,185

(22) PCT Filed: Nov. 30, 2004

(86) PCT No.: PCT/EP2004/013652

§ 371 (c)(1),
(2), (4) Date: Jun. 5, 2007

(87) PCT Pub. No.: WO2005/069444

PCT Pub. Date: Jul. 28, 2005

(65) Prior Publication Data

US 2008/0032550 A1 Feb. 7, 2008

(30) Foreign Application Priority Data

Dec. 19, 2003 (FR) ..... 03 15049

(51) Int. Cl.
*H01R 13/62* (2006.01)

(52) U.S. Cl. ..... 439/157; 439/347

(58) Field of Classification Search ..... 439/157, 439/347

See application file for complete search history.

(56) References Cited

U.S. PATENT DOCUMENTS 6,422,882 B1 * 7/2002 May et al. ..... 439/157
6,652,298 B2 * 11/2003 Ohnuki ..... 439/157

FOREIGN PATENT DOCUMENTS

DE 195 30 335 A1 2/1997
DE 196 38 368 A1 4/1998

* cited by examiner

*Primary Examiner*—Tho D Ta
(74) *Attorney, Agent, or Firm*—Harrington & Smith, PC

(57) ABSTRACT

The invention relates to a housing for a connector, including at least one contact-holder module, a frame for receiving this module and a stirrup which is used as an aid for coupling to an additional connector, which can be manoeuvred between a decoupling position and a coupling position between the housing and the additional connector, wherein the stirrup comprises means for retaining the module in a module lock position inside the frame.

20 Claims, 2 Drawing Sheets

DEVICE FOR LOCKING A CONNECTOR MODULE IN A MODULE HOLDER

The present invention concerns a device for locking a connector module in a module holder.

In the automobile field, in particular, it is known to provide electrical contact bearing modules and to install these modules in frames, forming module holders, which are provided with systems for assisting coupling such as mobile locking stirrups coupled with a complementary connector.

Such an arrangement permits, in particular, the pre-wiring of modules with their electrical contacts and the electrical wiring harnesses to which they are connected, then mounting them in their receiving frames to create complete connector housings.

The present invention concerns a connector housing having a device for locking the module in the frame in which the stirrup participates in locking the module, particularly in order to precisely position the module with regard to the complementary connector.

In order to do this, the invention principally concerns a connector housing comprising at least one contact holder module, a receiving frame for this module and a stirrup, for coupling with a complementary connector, that can be maneuvered between a decoupling position and a coupling position of the housing and the complementary connector, for which the stirrup has means for holding the module in a position for locking the module in the frame.

The module retaining means can notably be arranged so that they are active when the stirrup is in the position for coupling the housing and the complementary connector and inactive when the stirrup is in the decoupling position.

Advantageously, the module and the frame bear first complementary latching means for maintaining the module in locking position in the frame.

More particularly, the module and the frame may also comprise second complementary latching means for holding the module in a set-back position prior to mounting the module in the frame.

In a particular embodiment, the first latching means for the module in the frame comprise a spring digit borne by the frame and a first stop element borne by the module.

More particularly, the spring digit can cooperate with a second stop element borne by the module in order to create the second latching means.

The stirrup can notably be a stirrup sliding in the frame crosswise to the direction of coupling of the housing and the complementary connector, the means for holding the module comprising a cross rail that is supported on a shoulder of a rib of the module for locking the module in the frame.

According to one particularly advantageous embodiment of the invention, the module and the stirrup have complementary means for preventing a maneuvering of the stirrup when the module is not in locking position.

These complementary means for preventing maneuvering of the stirrup are advantageously made up by said rib and a frontal edge of said rail.

Figure 1:
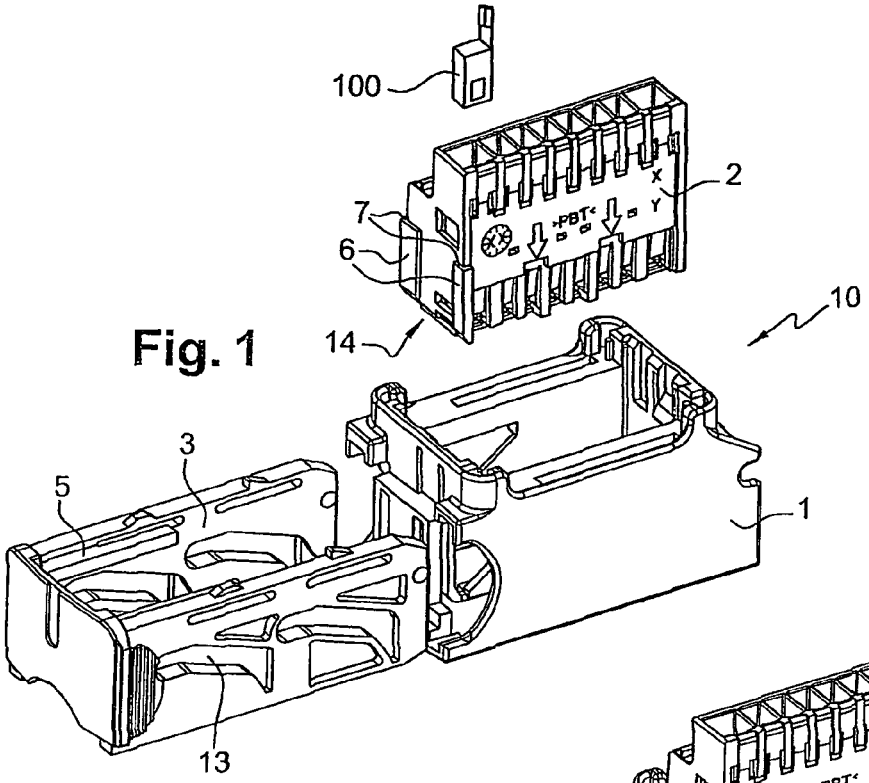

In FIG. 1: A perspective view of the components of a connector housing according to the invention.

Figure 2:
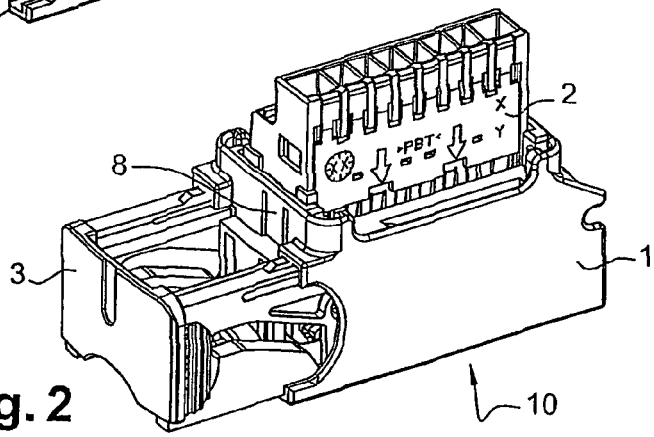

In FIG. 2: A perspective view of the housing of FIG. 1, with the module in pre-mounted position.

Figure 3:
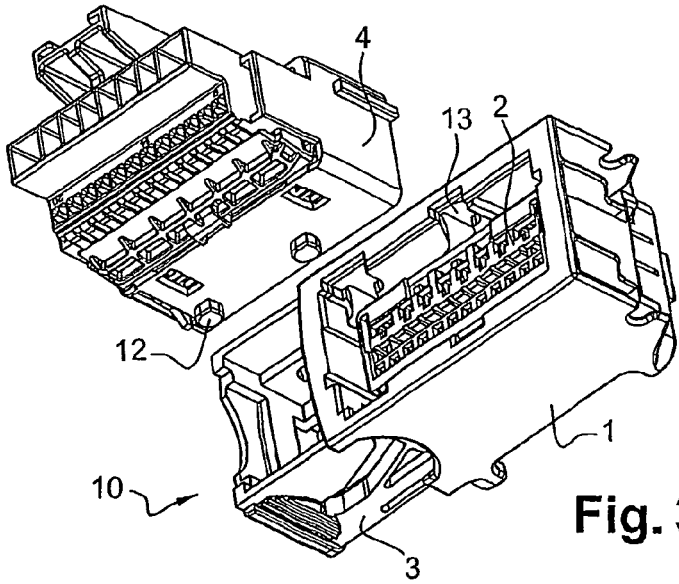
Figure 4:
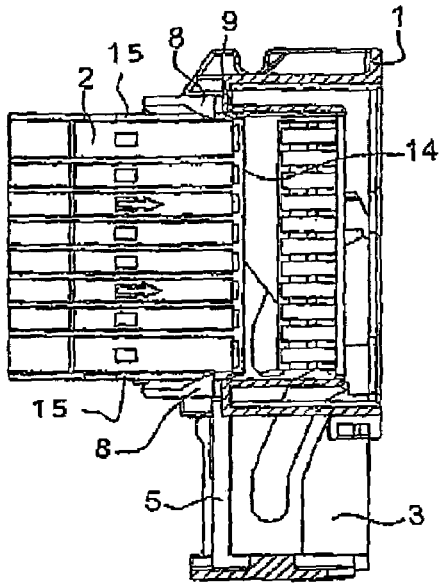

In FIG. 3: A view of the housing of FIG. 1 in position of coupling with a complementary connector housing;

In FIG. 4: A sectional view from the side of the housing of FIG. 1 with the module in the pre-mounted position.

Figure 5:
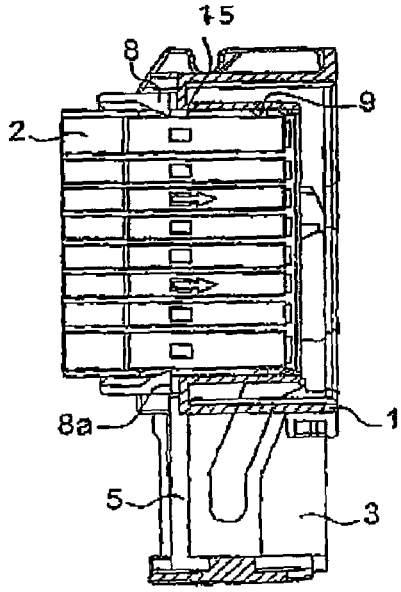

In FIG. 5: A sectional view from the side of the housing of FIG. 1 with the module in the mounted position.

Figure 6:
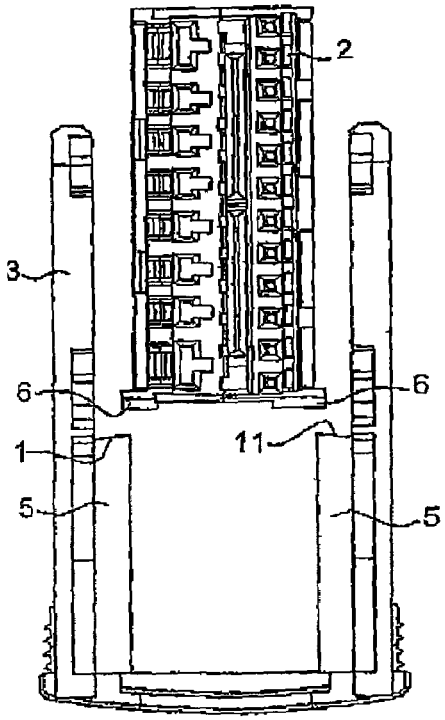

In FIG. 6: A bottom view of a module and a stirrup according to the invention, the stirrup being in decoupling position.

Figure 7:
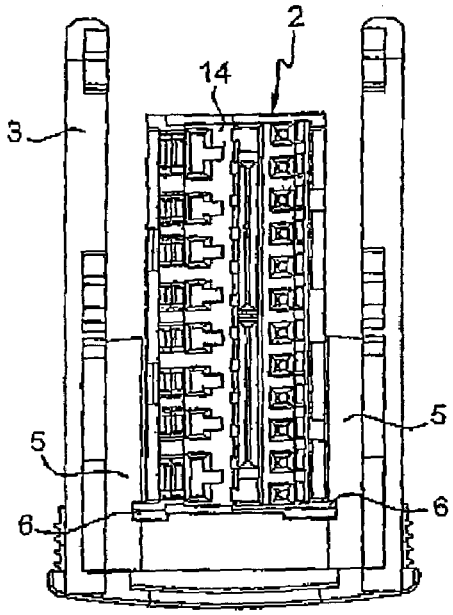

In FIG. 7: A bottom view of a module and a stirrup according to the invention, the stirrup being in coupling position.

The connector housing 10 shown in FIG. 1 has at least one module 2 bearing contacts 100. Such contact-holder modules are frequently used, notably within the scope of creating automobile wiring harnesses for facilitating the handling of the housings to be wired.

In contrast, when equipping a vehicle, it is desirable to provide for connection devices furnished with coupling aids, particularly lever or stirrup devices to facilitate the coupling of connectors either with one another or onto electronic equipment.

According to the example shown, the device for aiding coupling comprises a stirrup 3 provided with ramps 13 designed to receive pegs 12 borne by a complementary connector 4 shown in FIG. 4 to permit the coupling of housing 10 and complementary connector 4.

Stirrup 3 slides into a receiving frame 1 for module 2 and can be maneuvered between a position for decoupling housing 10 from complementary connector 4 for which pegs 12 are released from ramps 13 and a position for coupling housing 10 with complementary connector 4 for which pegs 12 are held at the bottom of ramps 13.

Module 2 is received in frame 1 and can be positioned in a pre-mounting position shown in FIGS. 2 and 4 and pressed into frame 1 into a locking position, which is shown particularly in FIG. 5.

In order to hold module 2 in locking position in frame 1, module 2 and frame 1 have first complementary latching means 8, 15 for holding the module in locking position in the frame. These means are made up of spring digits or tabs 8 on the frame and first stops or stop elements 15 on module 2. The spring digits have a face 8*a* resting against stops 15 which prevent withdrawal of the module. According to the example, two first stops are arranged on the lateral outer faces of the module and two digits are positioned on the inner faces of the frame facing said lateral faces.

In order to hold module 2 in the pre-mounting position in frame 1, the module and the frame have second complementary latching means 8, 9 for holding the module in a set-back position before mounting the module in the frame. These second means comprise spring digits 8 and second stops 9 positioned on the lateral faces of the module in front of the first stops relative to face 14 for coupling the module with complementary connector 4.

According to the present invention, stirrup 3 comprises means 5 for holding module 2 in a position for locking module 2 in frame 1. These holding means act on a surface of the module such as a shoulder on ribs 6 or the module pegs and permit applying coupling face 14 of the module against a corresponding face of complementary connector 4, and this is performed directly under the action of stirrup 3. Thus, according to the invention, the positioning of the module with regard to complementary connector 4 is no longer dependent on the dimensions and possible play in positioning the module in the frame but is directly obtained by resting the stirrup on the module during engagement of pegs 12 of the complementary connector in ramps 13 of the stirrup. In addition, there is no danger of loss of insertion force on the contacts borne by the module and by the complementary connector due to a possible lack of rigidity of the frame, since according to the invention, the stirrup rests directly on the module.

In contrast, in order to permit insertion of the module into the frame, the holding means are inactive when the stirrup is in decoupling position, i.e., they are disengaged.

As seen previously, stirrup 3 is a stirrup that slides in the frame crosswise to the direction of coupling of the housing and the complementary connector. For the stirrup to rest on the module during coupling of housing 10 with complementary connector 4, means 5 for holding the module comprise two cross rails 5 resting on shoulders 7 of ribs 6 of module 2. Thus, the stirrup locks module 2 in frame 1 and rests the module directly on complementary connector 4.

When the stirrup is in standby or decoupling position of the housing and a complementary connector, as diagramed in FIGS. 1 and 2 and in FIG. 6 where only the module and the stirrup are shown, the module can be inserted into the frame, and rails 5 of the stirrup are moved away from the path of ribs 6 during passage of the module from the pre-mounting position to the locking position. In contrast, if the stirrup is not in standby position, for example, it is in a position intermediate between the standby position and the coupling position, rail 5 prevents mounting the module in the frame.

In addition, when the module is positioned in the frame, maneuvering the stirrup from the standby position to the locking position is not possible as long as the module is not in locking position. In fact, if, for example, the module is in the pre-mounting position or in a position intermediate between the pre-mounting position and the locking position, rib 6 is found in the path of a frontal edge 11 of the rail and prevents a maneuvering of the stirrup.

In contrast, as shown in FIG. 7, when the module is in locking position, rails 5 of the stirrup can slide on the shoulders of ribs 6.

Thus, the device according to the invention permits a great precision for positioning module 2 with regard to complementary connector 4, an excellent transmission of the forces applied to stirrup 3 on module 2 during coupling with a complementary connector 4 and a secure operation, since stirrup 3 cannot be maneuvered from the decoupling position to the coupling position if the module is not in the locking position, but rather is in a position intermediate between the pre-mounting position and the locking position.

The invention claimed is:

1. A connector housing comprising at least one contact-holder module, a frame for receiving this module and a stirrup, wherein the stirrup is configured to couple with a complementary connector, wherein the stirrup is configured to be maneuvered between a decoupling position and a coupling position for the housing and the complementary connector, characterized in that the stirrup has means for holding the module in a locking position for locking the module in the frame.

2. The connector housing according to claim 1, further characterized in that the means for holding the module are arranged so that they are active when the stirrup is in the coupling position for coupling the housing and the complementary connector, and inactive when the stirrup is in the decoupling position.

3. The connector housing according to claim 1, further characterized in that the module and the frame have first complementary latching means for holding the module in the locking position in the frame.

4. The connector housing according to claim 1, further characterized in that the holding means is configured to block movement of the module in a direction parallel to a connection axis of the connector housing with the complementary connector.

5. The connector housing according to claim 1, further characterized in that the stirrup is a stirrup sliding in the frame crosswise to the direction for coupling the housing and the complementary connector, wherein the means for holding the module comprising a cross rail that rests on a shoulder of a rib of the module to lock the module in the frame.

6. The connector housing according to claim 5, further characterized in that the complementary means for preventing a maneuvering of the stirrup are made up of said rib and a frontal edge of said rail.

7. A connector housing comprising at least one contact-holder module, a frame for receiving this module and a stirrup, wherein the stirrup is configured to couple with a complementary connector, wherein the stirrup is configured to be maneuvered between a decoupling position and a coupling position for the housing and the complementary connector, characterized in that the stirrup has means for holding the module in a locking position for locking the module in the frame, further characterized in that the module and the frame have second complementary latching means for holding the module in a set-back position for pre-mounting of the module in the frame.

8. A connector housing comprising at least one contact-holder module, a frame for receiving this module and a stirrup, wherein the stirrup is configured to couple with a complementary connector, wherein the stirrup is configured to be maneuvered between a decoupling position and a coupling position for the housing and the complementary connector, characterized in that the stirrup has means for holding the module in a locking position for locking the module in the frame, wherein the connector housing further comprises first means for latching the module in the frame comprising a spring digit borne by the frame and a first stop element borne by the module.

9. The connector housing according to claim 8, further characterized in that the spring digit cooperates with a second stop element borne by the module to create a second latching means.

10. A connector housing comprising at least one contact-holder module, a frame for receiving this module and a stirrup, wherein the stirrup is configured to couple with a complementary connector, wherein the stirrup is configured to be maneuvered between a decoupling position and a coupling position for the housing and the complementary connector, characterized in that the stirrup has means for holding the module in a locking position for locking the module in the frame, further characterized in that the module and the stirrup comprise complementary means for preventing a maneuvering of the stirrup when the module is not in the locking position.

11. An electrical connector housing comprising:

a frame;

at least one contact-holder module configured to be inserted into the frame; and a stirrup movably connected to the frame, wherein the stirrup is configured to couple a complementary connector to the frame, wherein the stirrup is configured to be moved between a decoupling position and a coupling position for the frame and the complementary connector, and wherein the module and the stirrup comprise a system for preventing the stirrup from moving on the frame when the module is not in a locking position with the frame.

12. The electrical connector housing according to claim 11, further characterized in that the module and the frame have a first complementary latching system for holding the module in the locking position in the frame.

13. The electrical connector housing according to claim 12, further characterized in that the module and the frame have a second complementary latching system for holding the module in a set-back position for pre-mounting of the module in the frame.

14. The electrical connector housing according to claim 12, wherein the first complementary latching system comprises a spring digit borne by the frame and a first stop element borne by the module.

15. The electrical connector housing according to claim 14, further characterized in that the spring digit cooperates with a second stop element borne by the module to create a second complementary latching system for holding the module in a set-back position for pre-mounting of the module in the frame.

16. The electrical connector housing according to claim 11, wherein the stirrup has a holder configured to hold the module in the locking position.

17. The electrical connector housing according to claim 16, further characterized in that the holder is arranged so that it is active when the stirrup is in the coupling position for coupling the housing and the complementary connector, and inactive when the stirrup is in the decoupling position.

18. The electrical connector housing according to claim 16, further characterized in that the stirrup is a stirrup sliding in the frame crosswise to the direction for coupling the housing and the complementary connector, wherein the holder comprises a cross rail that rests on a shoulder of a rib of the module to lock the module in the frame.

19. The electrical connector housing according to claim 18, further characterized in that the system for preventing the stirrup from moving on the frame comprises the rib and the cross rail.

20. A connector housing comprising:

at least one contact-holder module;

a frame configured to receive the at least one contact-holder module; and a stirrup configured to couple with a complementary connector, wherein the stirrup is configured to be maneuvered between a decoupling position and a coupling position for the housing and the complementary connector, wherein the at least one contact-holder module and the stirrup comprise complementary means for preventing a maneuvering of the stirrup when the at least one contact-holder module is not in a locking position with the frame.

* * * * *